US005490456A

United States Patent [19]

Richardson et al.

[11] Patent Number: 5,490,456

[45] Date of Patent: Feb. 13, 1996

[54] AUTOMATED MULTIPLE STATION CAP PRINTING APPARATUS

[75] Inventors: Orland W. Richardson; Roger J. Gerdeman, both of Columbus, Ohio

[73] Assignee: ATM Machining Inc., Columbus, Ohio

[21] Appl. No.: 328,661

[22] Filed: Oct. 25, 1994

[51] Int. Cl.[6] ..... B41F 17/00; B41F 15/10

[52] U.S. Cl. ..... 101/35; 101/114; 101/115; 101/126; 101/127.1

[58] Field of Search ..... 101/35, 114, 115, 101/126, 127.1, 129, 123, 124

[56] References Cited

U.S. PATENT DOCUMENTS

| | | | |
|---|---|---|---|
| 1,252,043 | 1/1918 | Shourt | 101/40.1 |
| 4,266,476 | 5/1981 | Maloof | 101/35 |
| 4,381,706 | 5/1983 | Harpold | 101/127.1 |
| 4,753,161 | 6/1988 | Kimball | 101/35 |

OTHER PUBLICATIONS

Richardson Industries sales brochure; Manual Cap Printer.

Richardson Industries sales brochure; Model 1101 Automatic Cap Printer.

"Cap Printing Headware Decoration", Hal Hammer, Screen Printing. Dec. 1983.

*Primary Examiner*—Edgar S. Burr

*Assistant Examiner*—Lynn D. Hendrickson

*Attorney, Agent, or Firm*—Francis T. Kremblas, Jr.

[57] ABSTRACT

A multiple station automated cap printer includes a plurality of printing heads mounted in fixed circumferentially spaced relationship to one another and are vertically movable between a raised non-printing position and a lowered printing position. A plurality of printing mandrels are disposed in fixed circumferentially spaced relationship to one another and rotatably mounted about a vertical axis between releasably fixed and precisely aligned positions below a respective one of the printing head. The mandrels include a cylindrical cap receiving platen which is rotatably mounted about an axis of rotation extending in a radial direction relative to the rotational path of the mandrel. Each mandrel includes a trolley frame which carries the cylindrical platen in a linear path which mirrors the linear path of travel of a squeegee mounted within each of the printing heads while the platen is rotated through an arcuate distance equal to the linear path of travel of the squeegee. The linear travel of the squeegee across a printing screen mounted in the printing head defines a tangential path relative to the rotary path of travel of the printing mandrels between printing stations.

5 Claims, 12 Drawing Sheets

AUTOMATED MULTIPLE STATION CAP PRINTING APPARATUS

TECHNICAL FIELD

The present invention relates generally to direct screen printing wherein ink is transferred directly onto a substrate through a screen carrying a given design or indicia and particularly to apparatus for screen printing billed caps and the like.

BACKGROUND ART

Screen printing, wherein ink is directly transferred onto a substrate, has grown dramatically over the past few decades into a very high volume business. Among the more popular items of wearing apparel carrying various printed indicia are billed caps. The printed indicia may include letters, numerals, designs or a combination thereof in one or more colors. Currently, caps are screen printed on manually operated, single station machines using either a flat or round cap holding platen or mandrel. Since the cap portion being printed is made in a round or cylindrical configuration, there are inherent problems using a flat platen associated with maintaining the most desirable relationship between the print screen and the cap. After the cap is printed and resumes its normal cylindrical shape, a certain amount of distortion is evident.

Using a round mandrel can significantly reduce the distortion problem, however, the complex action involved wherein the printing platen must move horizontally and also rotate presents difficult and heretofore unsolved problems in a carousel type, multiple station configuration.

While the prior art includes many types and forms of multiple station, multiple color printing machines using a flat platen for printing on a flat surface, those of ordinary skill have failed to provide an automated multiple station, multiple color printer for cylindrical surfaces such as caps which is capable of high volume, high quality printing in an economical manner.

BRIEF DISCLOSURE OF INVENTION

The present invention relates to cap screen printers and particularly to a multiple station, multiple color automated cap printer capable of high quality multiple color screen printing on caps.

In accordance with a preferred embodiment of the present invention, a six station, four color cap printer having six rotating cylindrical cap holding mandrels mounted in a carousel configuration below four rotationally fixed printing heads. The mandrels face radially outward for convenient front loading and unloading at two of the stations and are rotatably mounted on a horizontal shaft independently of their rotation about a vertical axis between the six stations. Each printing mandrel is caused to move laterally and rotate about a horizontal axis during the printing cycle in coordination with the linear travel of a squeegee assembly mounted on the printing head which forces ink through a conventional printing screen to impart the printed image on the cap.

The squeegee assembly, unlike prior art carousel printing apparatus, travels across the screen at generally a right angle to the radius of rotation of the cap holding mandrels between stations and in a generally horizontal plane during the printing cycle. The circumferentially fixed printing heads mounting for vertical movement between printing and non-printing positions and are lowered into proper relationship with the printing mandrel only after the mandrels have been indexed into the selected alignment for printing.

In this manner, very high quality printing of caps in multiple colors and at high volume is realized at very significantly lower labor costs compared to the prior art machines.

Also described is a simple and very reliable means to coordinate the linear speed of travel of the squeegee assembly with the linear and rotational speed of the cap holding mandrel so that a clear, undistorted print image is transferred to the cap's surface.

DETAILED DESCRIPTION

Figure 1:
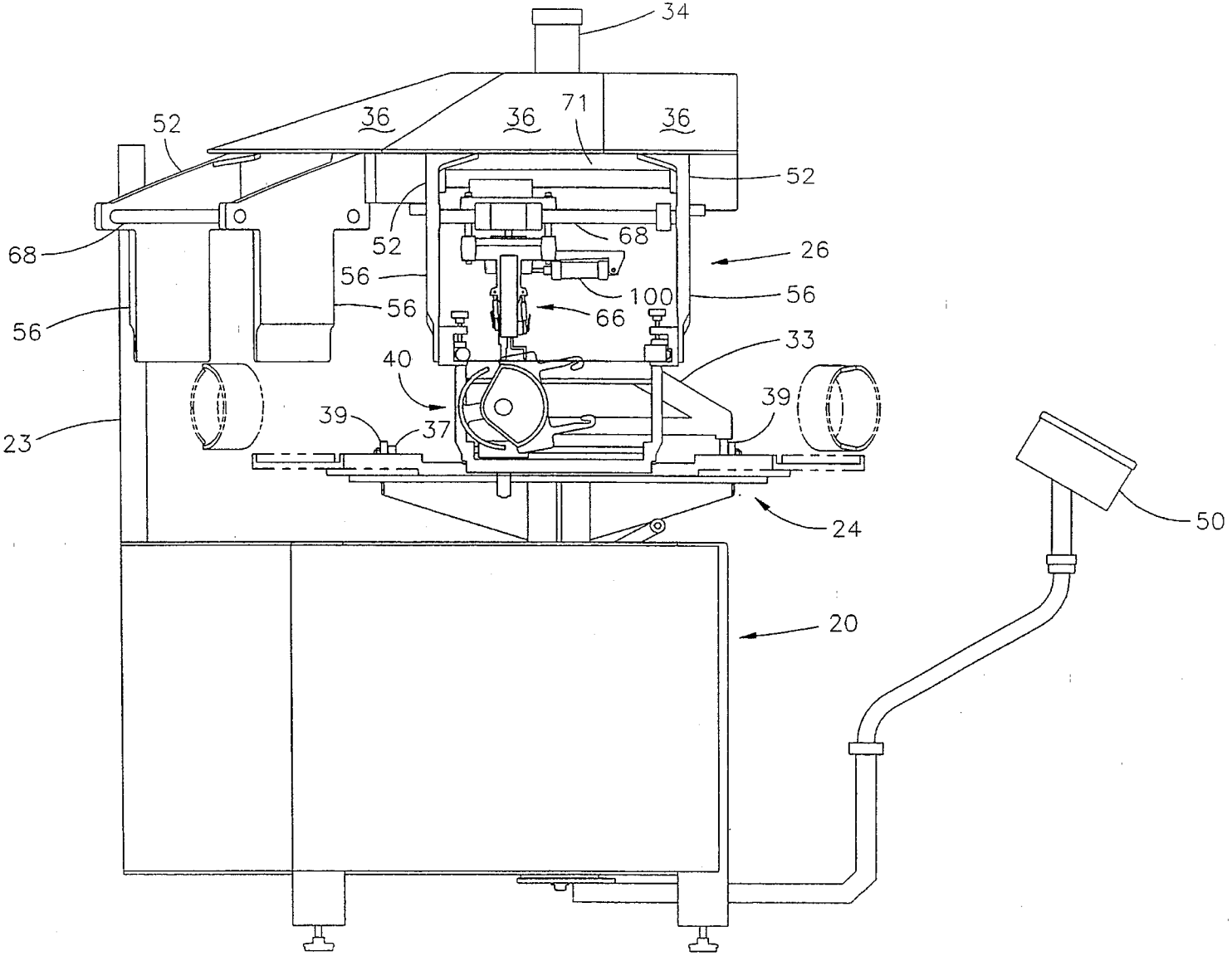
FIG. 1 is a side elevational view of an automated screen printing apparatus constructed in accordance with the present invention with only one station being shown in full lines and adjacent stations being identical merely outlined in phantom lines for purposes of brevity.
Figure 2:
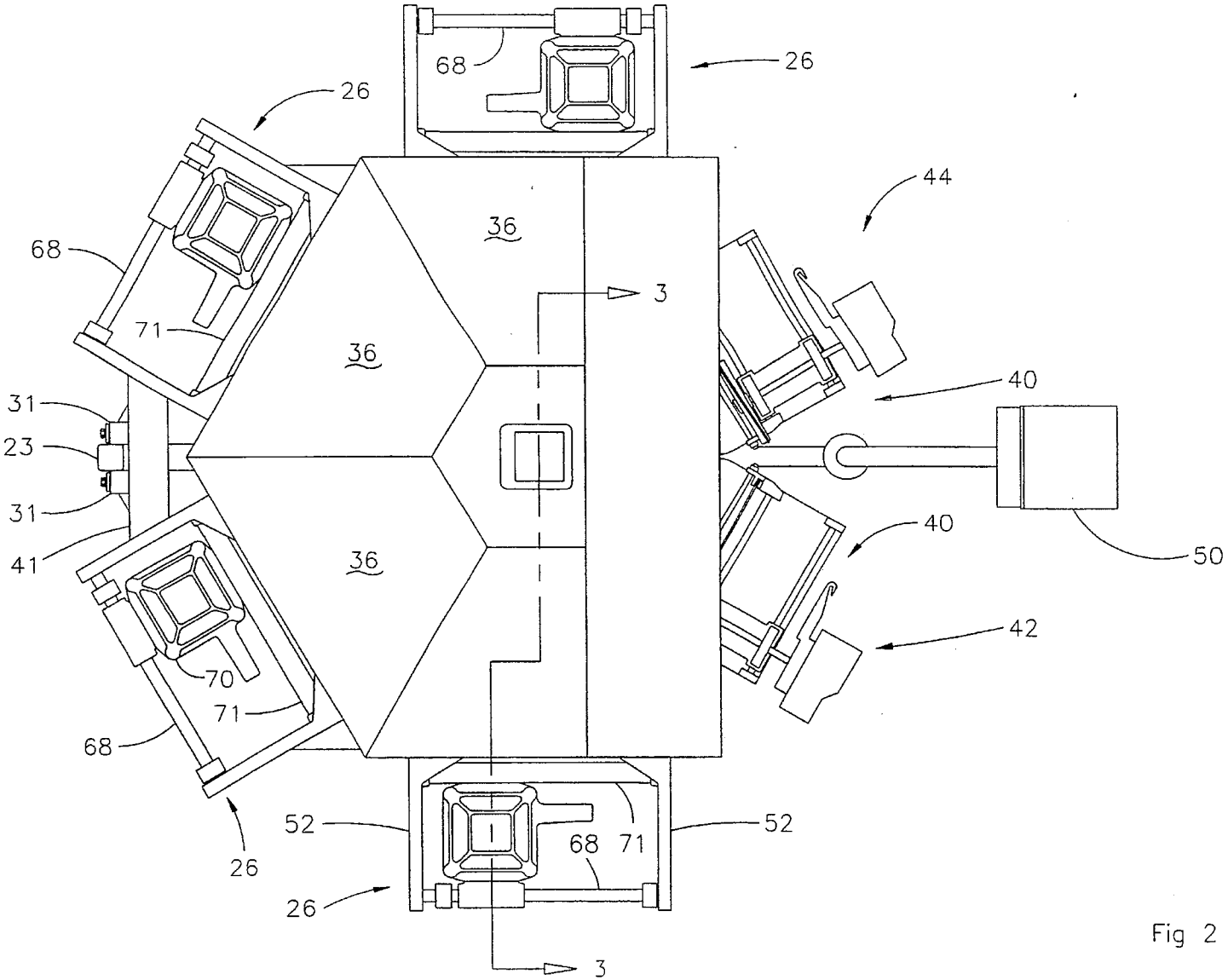
FIG. 2 is a top plane view of the apparatus shown in FIG. 1, the position of all six stations being shown in FIG. 2.
Figure 3:
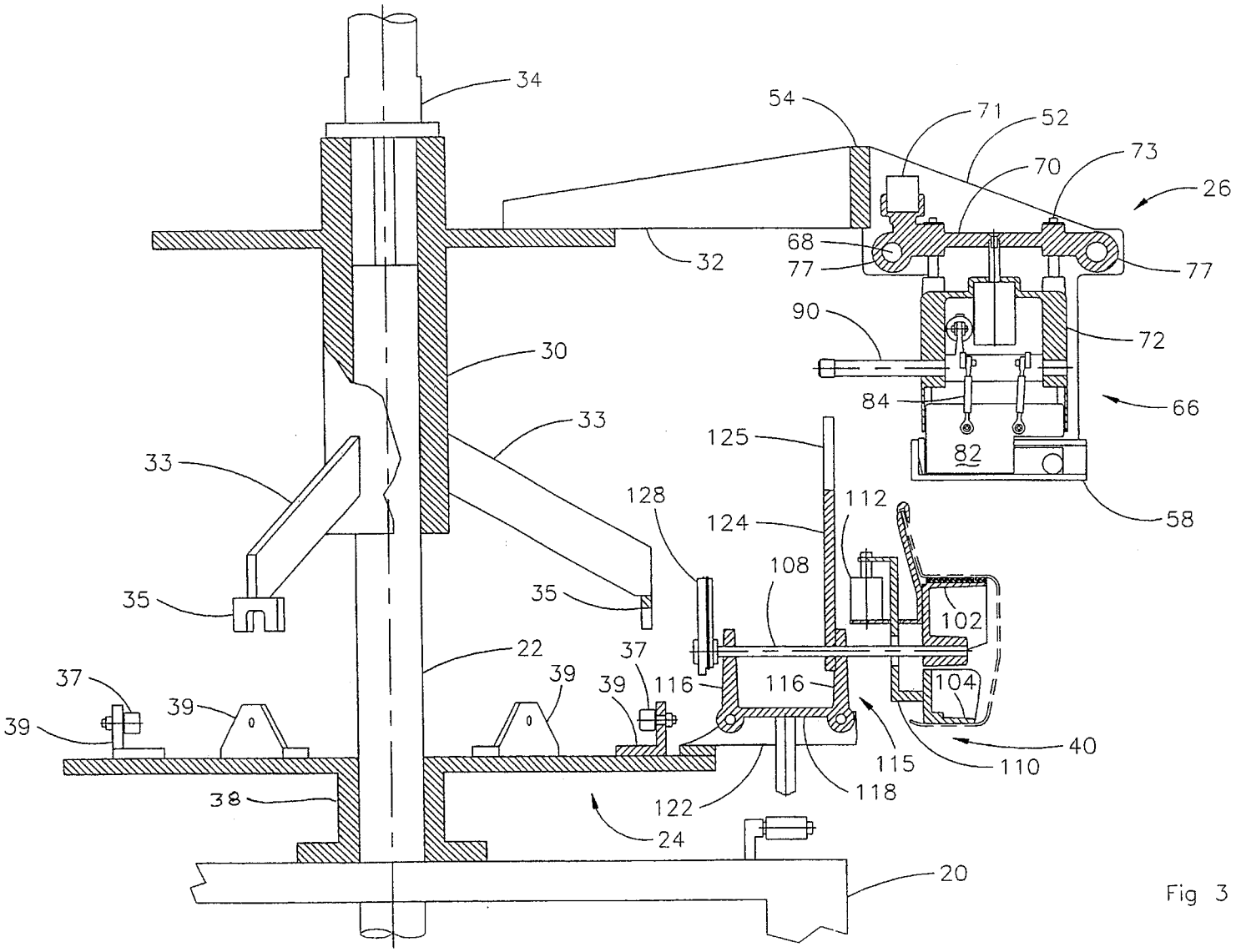
FIG. 3 is a partial side sectional view along line 3—3 in FIG. 2 illustrating the relationship between a printing head and cap holding mandrel at a printing station in the apparatus shown in the preceding figures.

An automated multiple station cap screen printing apparatus constructed in accordance with the present invention is illustrated in FIGS. 1–3 and includes a base frame unit indicated generally at 20 which houses a conventional geneva type indexing unit, not shown, which is well-known to those skilled in the art to be capable of providing rotation of a shaft, such as 22, connected to a support table or carousel such as indicated generally at 24, between selected, precisely located, circumferentially spaced positions. Other forms of current or future indexing apparatus capable of a similar function to operate a carousel type printing apparatus would be expected by those skilled in the art to be equivalent for purposes of the present invention to cause spaced printing mandrels to rotatably move between precise, releasably fixed locations defining printing or loading and unloading stations.

In the preferred embodiment shown, a six station, four color carousel type cap printing apparatus is shown having four printing head assemblies, indicated generally at 26, fixed in selected, circumferentially spaced locations about the axis of control shaft 22 by a printing head support frame.

Printing head support frame rests upon the upper end of shaft 22 with bearing surfaces provided to permit shaft 22 to rotate freely within a collar or sleeve support 30 having outwardly extending arms 32 to which printing head assemblies 26 are fixedly mounted as best seen in FIG. 3.

Sleeve support 30 is slideably mounted on the upper end of shaft 22 and operatively connected to a conventional double acting piston and cylinder assembly 34 which raises and lowers collar support 30 to effect vertical movement of the associated printing head assemblies 26 between printing and non-printing position as well as during a printing cycle as described in detail later herein.

Protective and decorative cover plates such as 36 are optional but can be fixed to the arms 32 for such desirable purposes.

As best seen in FIGS. 1 and 3, support table 24 includes a collar 38 fixed to shaft 22 in any suitable conventional manner for rotation therewith as dictated by preferably a geneva type indexing apparatus, not shown, disposed in base frame 20 as previously referred to herein.

Support table 24 carries six cap holding mandrel assemblies, indicated generally at 40, which are evenly circumferentially spaced about the vertical axis of shaft 22 for sequential rotation to the precise indexed positions beneath each printing head assembly 26 and at a loading and unloading station indicated generally at 42 and 44 respectively as seen in FIG. 2.

Preferably one operator working at loading station 42 places a cap on the mandrel assembly 40 and another operator removes a printed cap from mandrel assembly 40 at unloading station 44, after the particular mandrel assembly 40 has rotated through a complete revolution past each printing station.

Figure 11:
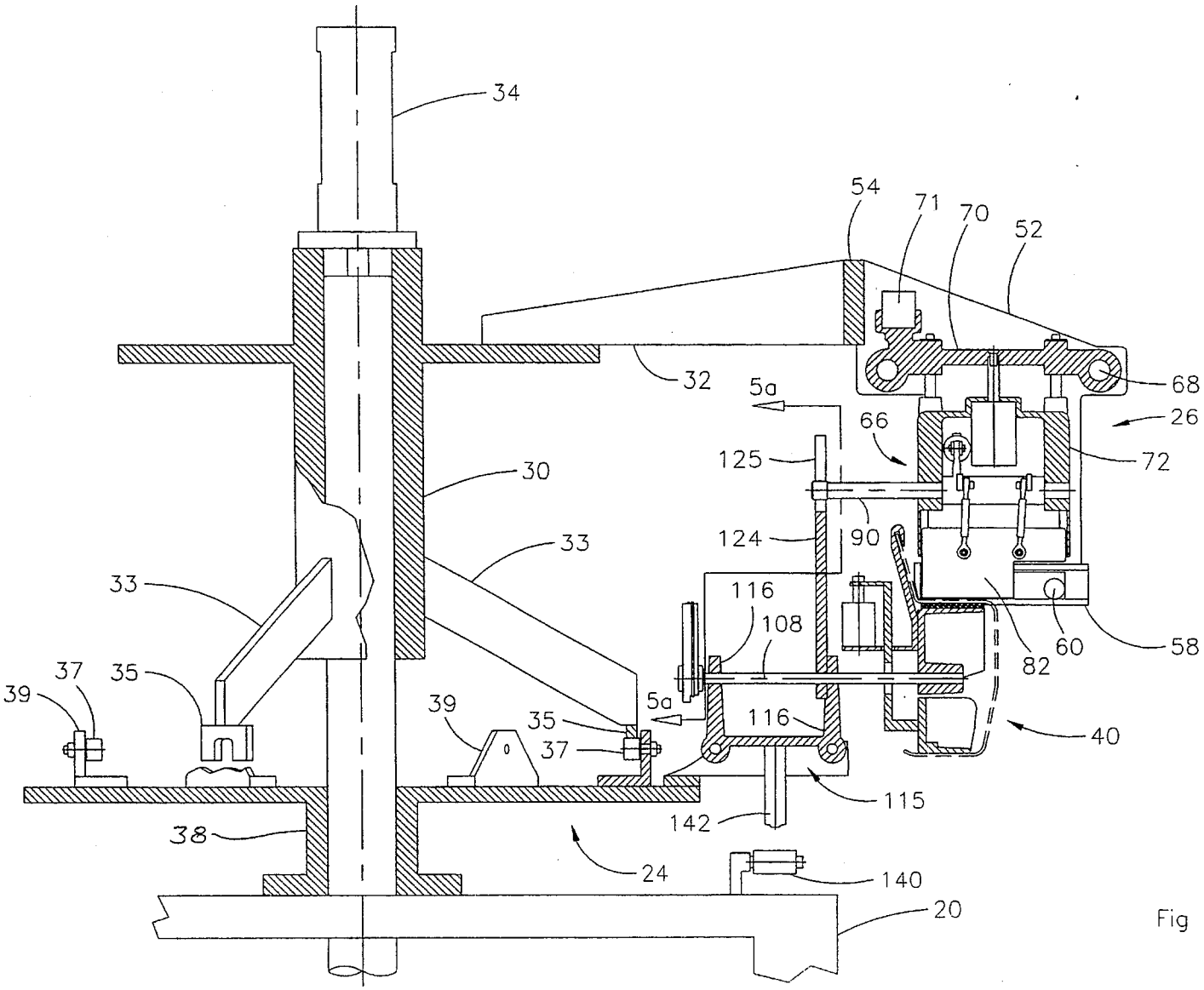
Figure 12:
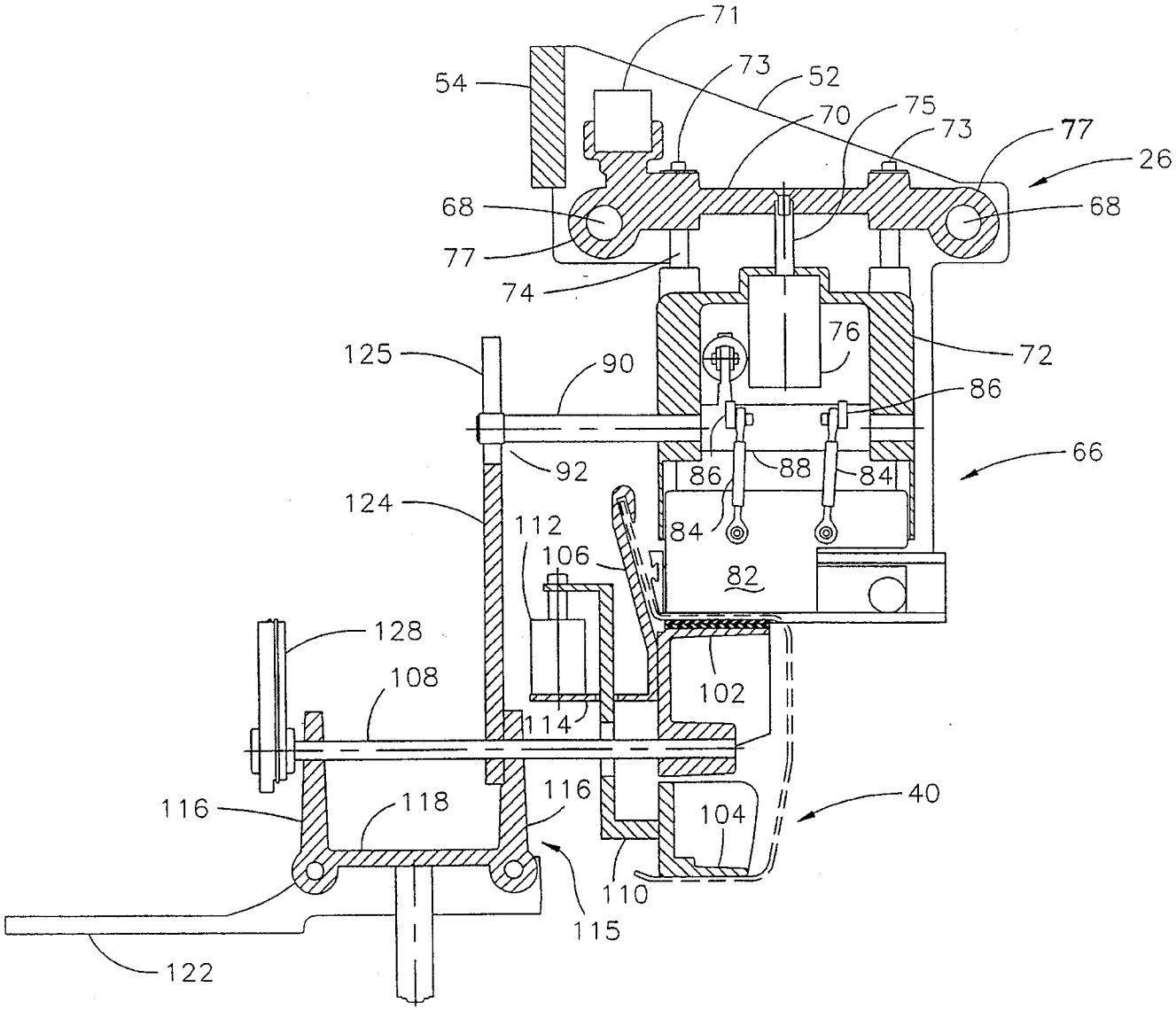
FIG. 12 is a side sectional view similar to FIG. 11 except showing only the printing head assembly and the mandrel assembly apart from the base frame.

As each cap holding mandrel assembly is rotated to one of the precisely located printing positions under a respective printing head assembly 26, piston and cylinder assembly 34 is actuated to lower sleeve support 30 from a raised non-printing position, such as shown in FIG. 11, to a fully lowered printing position, shown in FIG. 3 in order to properly position the printing head and mandrel assemblies relative to one another for the printing cycle. Upon raising sleeve 30 to its upper position shown in FIG. 11, the mandrel assemblies 40 may be rotated to the next station without interference or obstruction.

The control of piston and cylinder assembly 34 as well as the control for such all other pistons employed to move the various parts of the apparatus as later described herein may be accomplished using conventional means well-known to those skilled in the art and which may be conventionally connected to a control panel, such as 50, conveniently located for an operator adjacent to the loading station 42. Typically, a combination of fluid power and electrical components is deemed the better mode for actuating and controlling the desired movements of the operative elements of the apparatus of the present invention, however those of ordinary skill may choose any combination among well-known alternatives to accomplish the desired results.

Sleeve 30 also carries three equally spaced downwardly inclined arms, such as 33. Each arm 33 carries a notched plate 35 which is fixed by welding or the like to its lower end. As seen in FIG. 3, when sleeve support 30 and the associated printing heads are lowered into a printing position, each notched plate 35 engages one of six equally spaced, precisely located bearings 37 which are fixed to a mounting flange 39 which in turn is fixed to support table 24. Preferably, six equally spaced, precisely located bearing members 39 are provided on table 24 so that three are aligned with a notched plate 35 when table 24 reaches an indexed position during its sequential rotation. This mating between plate 35 and bearing 37 precisely locates the lowest point of vertical travel for collar support 30 and printing heads 26 relative to mandrel assemblies 40 and further functions to releasably lock collar support 30 to support table 24 against relative rotational movement so that the precise initial registered alignment between printing assemblies 26 and mandrel assemblies 40 is maintained during the printing cycle.

As best seen in FIGS. 1 and 2, collar support 30 is otherwise fixedly positioned against rotation about shaft 22 by a vertically disposed support post 23 fastened at its lower end to base frame 20 and is slideably mounted between a pair of bearing 31 fastened to a support bar 41 to allow slideable vertical motion, but restricts rotational motion about shaft 22 to establish the initial fixed circumferential position for each printing head assembly 26 which is precisely coordinated with the indexed position of each mandrel assembly 40 located at a printing station by a geneva type indexing apparatus as earlier referred to, or an equivalent rotating and locating mechanism.

Therefore, in view of the foregoing description, one skilled in the art would understand that each printing head assembly is radially spaced from the vertical axis of central shaft 22 at the ends of arms 32 and circumferentially spaced from one another in a precisely located fixed position relative to rotating support table 24 upon which the circumferentially spaced mandrel assemblies 40 are mounted. Mandrel assemblies 40 rotate with support table 24 about a vertical axis defined by shaft 22 between selected, releasably fixed positions under each printing head assembly 26. In this arrangement and employing any one of many alternative print screen mounting means which form part of the printing head assembly, very precise registration of the print screen and a fixed mandrel location can be accurately registered with one another as is well-known and understood by those of ordinary skill in the art. Such print screen mounting means typically employ channels or clamps or a combination thereof to accept and releasably fix the frame holding the ink printing screen. Preferably, some form of fine adjustment is provided to permit precisely locating each screen in each one of the multiple printing heads to more accurately print the desired multi-colored image as is generally well-known to those of ordinary skill in the art.

Figure 10:
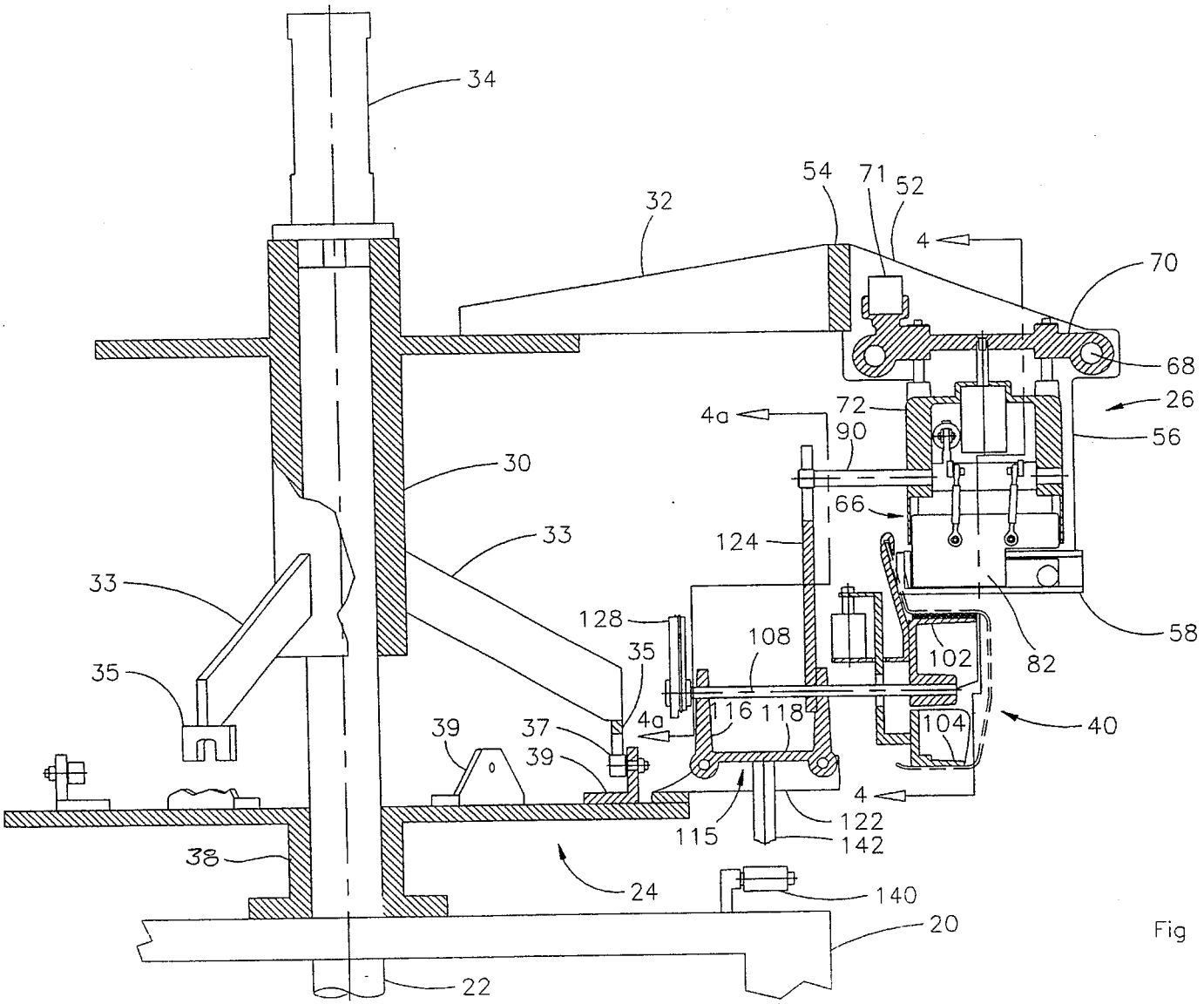
FIGS. 10 and 11 are side sectional views similar to the view shown in FIG. 3 illustrating the vertical movement of the printing head relative to the cap holding mandrel during a printing cycle.

As best seen in FIGS. 3, 10 & 11, a printing head assembly 26 and mandrel assembly 40 are shown in detail. Since each of the assemblies 26 and assemblies 40 are identical in construction, it is only necessary to describe one and its relationship to the other during operation for understanding of the present invention by one of ordinary skill in the art in connection with the prior description herein and the drawings.

FIGS. 3, 10 and 11 show the vertical movement of sleeve support 30 and a printing head assembly 26 as driven by piston and cylinder assembly 34 between a lowered printing position in relationship to mandrel assembly 40 and a raised non-printing relationship wherein mandrel assembly 40 is free to rotate to the next station.

FIG. 4–9 illustrate the same sequence of the vertical relationship between assemblies 26 and 40 as shown in FIGS. 3, 10 and 11, and in addition, illustrate the linear motion of the squeegee assembly and the mandrel assembly 40 during a printing cycle. The printing head assembly 26 and mandrel assembly 40 are illustrated without showing their connection to the remainder of the apparatus in FIGS. 4–9 for clarity and simplicity purposes as this relationship is adequately shown and described herein with regard to the remaining figures.

Now referring specifically to FIGS. 2, 3 and FIGS. 4 and 4*a*, printing head assembly 40 includes a mounting bracket or frame which includes side plates 52 which are conventionally mounted to a panel or plate 54 by fasteners or the like. Plate 54 may be conventionally fixed to arm 34 by welding, threaded fasteners or other well-known means.

Side plates 52 include a downwardly depending leg portion 56 at each corner to form an open frame-like structure. A print screen mount 58 is fixedly connected in a conventional manner to leg portions 56 such as by welding or the like, to define a generally rectangular frame having side channels 59 and a rear wall, not shown, and a frontal opening formed to receive a conventional print screen frame 60 carrying screen 62 having the desired image or print indicia conventionally formed thereon. Print screen frame 60 also forms a reservoir to hold a supply of ink which can be spread across the screen 62.

A pair of threadably adjustable clamps 64 are conventionally provided to releasably fix print screen frame 60 within channels 59 in a well-known conventional manner. It is most desirable to also provide for fine adjustment of the position of screen holding frame 60 within channels 59 to better assure consistent registration location of the respective screens placed in each print head assembly spaced about the apparatus for multiple color printing. Such details are not included herein as they form no part of the present invention standing alone and it is well-known and understood by those skilled in the art that multiple color printing requires consistent, accurate placement of the screens in each respective print head to obtain the most desirable print image without overlapping or misalignment of the different colors used.

A squeegee assembly 66 is mounted within the open frame defined by side plates 52 and legs 56 and include a pair of guide rails 68 fixed between the side plates 52 and a carriage or trolley frame 70 which includes a pair of spaced collar bearing 77, one of which in turn are slideably mounted on a respective rail 68. Carriage frame 70 includes a recess adapted to accept a conventional rodless band cylinder 71 which is conventionally mounted to side plates 52 and connected to frame 70 to drive frame 70 reciprocally across guide rails 68.

A squeegee and flood bar mounting bracket 72 is connected to carriage 70 for horizontal movement therewith via four threaded posts 74. Mounting bracket 72 is slideably mounted between threaded nuts such as at 73, on threaded opposing ends of each post 74 and is vertically movable along posts 74 as driven by a piston 75 mounted in cylinder 76. The piston 75 extends through an opening in bracket 72 and is fixed at its outer end to carriage 70 via a threaded fastener 80 received in a threaded bore in the end of piston 75. The upper end of cylinder 76 engages the underside of mounting bracket 72 such that extension or retraction of piston 75 causes mounting bracket 72 to slide vertically along posts 74.

A conventional squeegee 82 is mounted to one end of a pair of turnbuckles 84 for slideably movement in a vertical direction between a vertically disposed print plate and a planar clamp surface, not shown. The opposing end of turnbuckles 84 are connected to a respective one of a pair of ears 86 fixed to one side of a hub 88 which is rotatably mounted on a shaft 90 which is fixed within bracket 72 and includes an outwardly extending end 92. A flood bar 94 is similarly mounted for vertical slideable movement within bracket 72 and is connected to a pair of laterally spaced short posts 96 fixed to flood bar 94. The lower end of another pair of turnbuckles 84 are connected to posts 86 and the upper ends are connected to another pair of ears 86 fixed to hub 88.

Hub 88 also includes an upwardly extending ear 98 which is pivotally mounted to the end of a piston and cylinder assembly 100 to provide a bell-crank action to drive the turnbuckles 84 on opposing sides of hub 88 in an alternating vertical path of travel which causes the squeegee and flood bar to alternately raise or lower upon actuating a retracting or extending stroke of piston 100.

Figure 4:
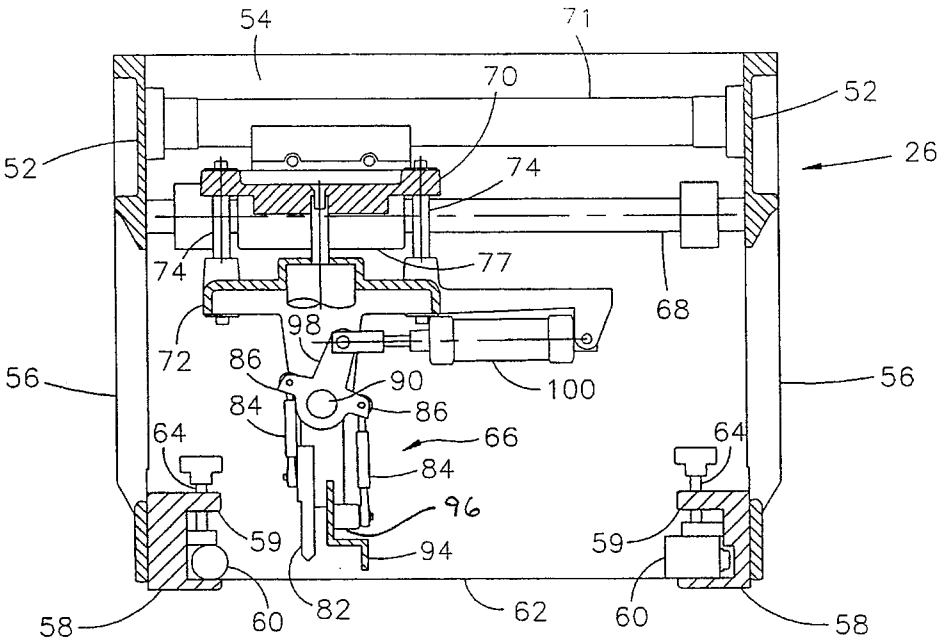
FIG. 4 is a partial sectional view diagrammatically illustrating the positional relationship between a printing head and its associated squeegee assembly with a cap holding mandrel disposed at a printing station at the beginning of a printing cycle forming a part of the apparatus shown in the preceding figures; the section being taken along line 4—4 in FIG. 10.
Figure 4:
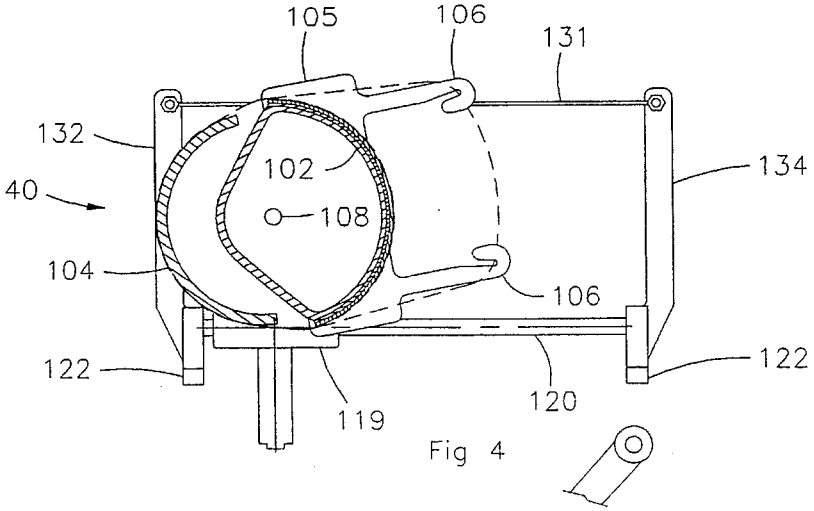
Figure 4A:
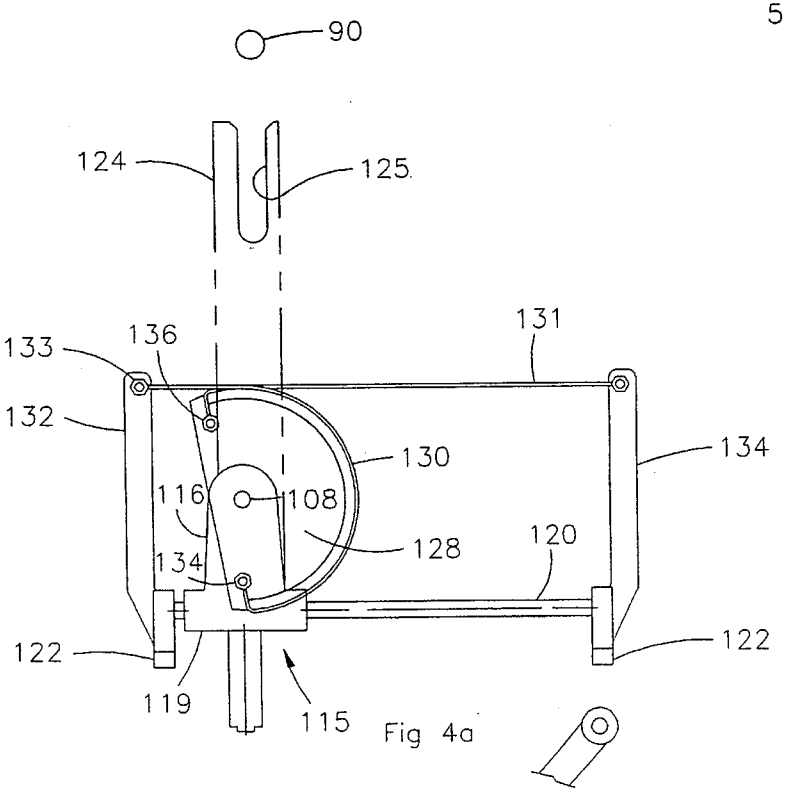
FIG. 4*a* is a partial sectional view of the apparatus shown in the preceding figures illustrating only the trolley and cable mechanism which effects rotation of the cap mandrel, the section being taken along line 4*a*—4*a* in FIG. 10, the trolley and cable mechanism being shown in the starting position commensurate with the mandrel and squeegee assembly position shown in FIG. 4.

Mandrel assembly 40 includes a cylindrical shaped mandrel including a printing platen portion 102, a tension foot portion 104 and a plate 105 including a pair of bill retaining legs 106 fixed to platen portion 102 to securely receive a cap 108 over the mandrel as shown in FIGS. 3 and 4.

Printing platen portion 102 and foot tension portion 104 each are fixed to rotatable shaft 108. Foot tension portion includes an upwardly extending plate 110 connected to the piston of a piston and cylinder assembly 112. The cylinder portion of assembly 112 is fixed to a flange plate 114 which in turn is fixed to platen portion 102 via plate 105.

Plate 110 includes an opening larger than the diameter of shaft 108 so that actuation of piston and cylinder 112 cause foot tension portion to move downwardly away from platen portion 102 to effectively expand the diameter of the mandrel to more firmly grip a cap placed over the mandrel as shown in the drawings and yet permit platen portion and tension foot portion to rotate with rotation of shaft 108 as a single unit. It should be noted that a spring tension element could also be applied in conjunction with the piston and cylinder arrangement if desired to provide the required action to securely grip the inner head portion of the cap for printing purposes and relax the tension to permit the cap to be more easily mounted and removed from the mandrel.

The cap holding mandrel as a whole is mounted for lateral movement by a second trolley frame or carriage configuration indicated generally at 115 which includes a pair of spaced upstanding ears 116 provided with aligned bores to rotatably accept shaft 108. Ears 116 are connected to opposing ends of a cross bar or plate 118 which includes spaced collars forming slide bearings 119 to accept a respective one of guide rods 120 which are fixed to and supported by a mounting bracket 122 which in turn is fixedly mounted to support table 124 such that the trolley frame 115 and its associated ports rotates with support table 24.

Also provided on trolley frame 115 is an upstanding post 124 which is fixedly mounted to one of the ears 116 and includes a bore which also rotatably accepts shaft 108. The upper end of post 124 is provided with a U-shaped recess 125 which is adapted to receive the outer end 92 of shaft 90 extending from squeegee assembly 66 when mandrel assembly 40 is indexed into a printing position and printing head assembly 26 is lowered via the action of piston and cylinder assembly 34 into a printing relationship with mandrel assembly 40. At this point the engagement between post 124 and the outer end 92 of shaft 90 ties the lateral motion of the squeegee assembly 66 along guide rails 68 to mandrel assembly 40. Therefore carriage 115 and the associated portions 102, 104 and 106 of mandrel assembly 40 move along guide rods 120 parallel to and at the same linear speed as squeegee assembly 66 via the driving connection between shaft 90 and post 124.

Additionally, the inner end of shaft 108 is fixed to a drum 128. A pair of cables 130 and 131 are provided wherein one end of cable 130 is fixed to a vertical leg 132 mounted on mounting bracket 122 and the remainder is wrapped around a predetermined circumferential arc of drum 128 where the opposing end is fixed to drum 128, such as at 134. The other cable 131 has one end fixed to an opposing vertical leg 134 which is mounted to the opposing end of bracket 122 and the opposing end is fixed to drum 128, such as at 136. As the trolley frame 115, shaft 108 and drum 128 are moved laterally along guide rods 120, cables 130 and 131 cause drum 128 to rotate counterclockwise and clockwise as the carriage 115 moves from left to right and returns right to left respectively. The diameter of the drum is selected to be generally equal to the diameter of the mandrel portions 102 and 104 and the caps to be printed such that the circumference of the arc of rotation of drum 128 as described closely matches the desired arcuate circumference available for printing across the forward portion of the cap above the bill of the cap.

Further, the linear speed of travel of the squeegee 82 across screen 62 is effectively matched with the equivalent linear speed of the rotation of the mandrel and the associated cap held thereon so that the linear distance and circumferential distance of travel is essentially equal. The effect of this matching is that the cap surface is presented to the printed image of screen 62 as if the cap surface were flat and stationary relative to the flat screen 62 as the squeegee is moved across the screen 62. However, because the cylindrical mandrel holds the cap in its cylindrical configuration during the printing stroke, there is no distortion of the printed image such as occurs when a cylindrical cap surface is forced onto a flat printing platen and then restored to its original configuration after printing.

For purposes of illustrating the operation of the cap printing apparatus of the present invention, an operator at station 42 mounts a cap over the mandrel portions 102 and 104 with the bill portion of the cap inserted against the legs 106 of bill retaining plate 105. The hook-like edges of legs 106 aid in retaining and aligning the cap in the proper position. Then the operator via control panel 50 presses an actuation switch to actuate rotation of support table 24 to index each mandrel assembly 40 to the next position and repeats the cap mounting with another cap.

As a mandrel assembly 40 is indexed to the first printing station, it is accurately located via a geneva type index mechanism, not shown, beneath the printing head assembly 26. In the fully automated design, upon reaching the indexed position, a signal is generated to actuate piston and cylinder 34 to lower sleeve support 30 downwardly along shaft 22 which lowers a respective one of printing head assemblies 26 from its raised non-printing position, such as shown in FIG. 3 into its printing position as shown in FIG. 11, with the printing screen 62 disposed in closely adjacent relationship to a cap positioned on the cap holding mandrel as earlier described herein. Preferably, a photoelectric sensor is provided, not shown, such as on arm 32, to detect whether or not a cap is mounted on the mandrel assembly. If no cap is mounted thereon, the sensor would generate a signal which prevents actuation of movement of the squeegee assembly.

However, if a cap is positioned on the mandrel, the squeegee assembly 66 is automatically actuated by the firing of band cylinder 71 to cause the assembly 66 carrying squeegee 82 to travel from left to right across screen 62 a predetermined distance matched to the equivalent circumferential distance of the arc of rotation of the cap holding mandrel portions as earlier described herein.

Figure 5:
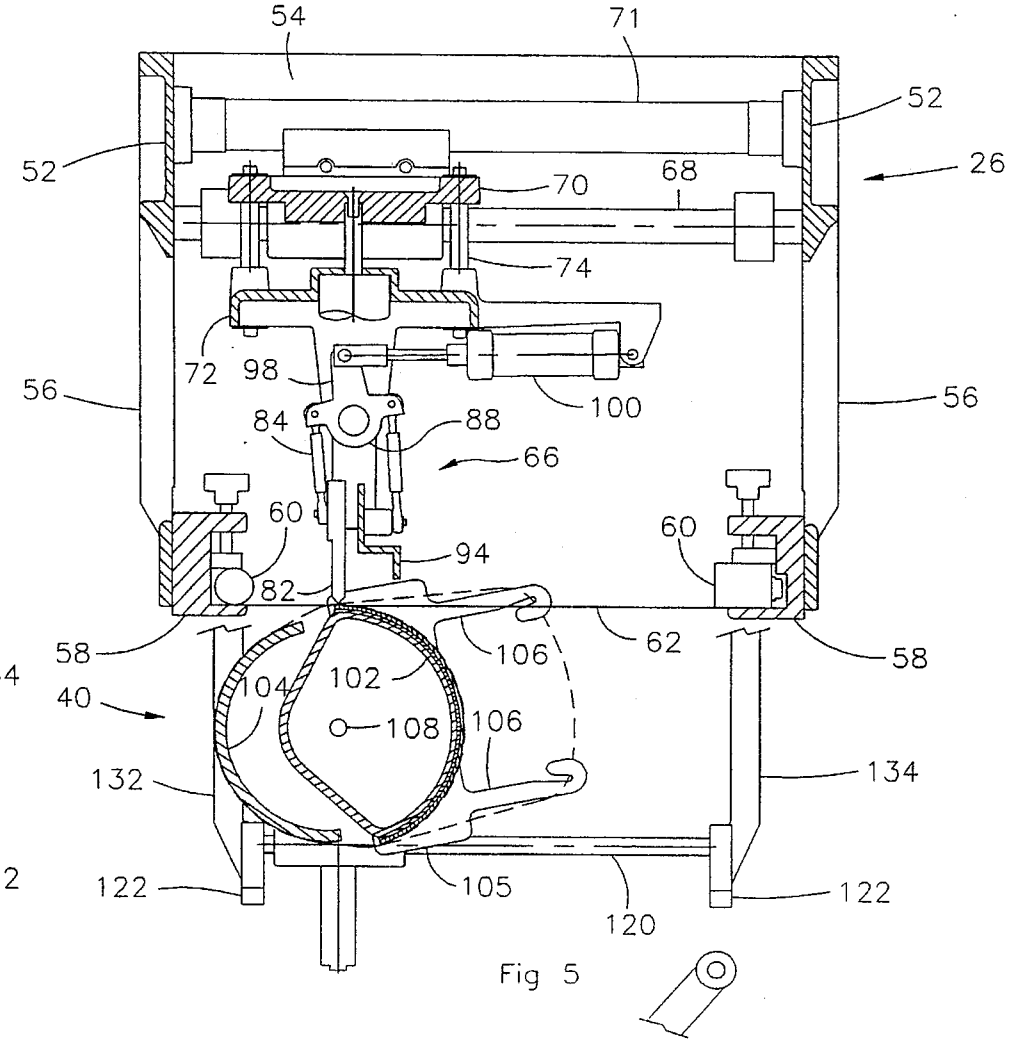
FIGS. 5 and 5*a* are partial views of the apparatus shown in the preceding figures illustrating the same portions shown in FIGS. 4 and 4*a* as the printing head is initially lowered into a printing position.
Figure 5A:
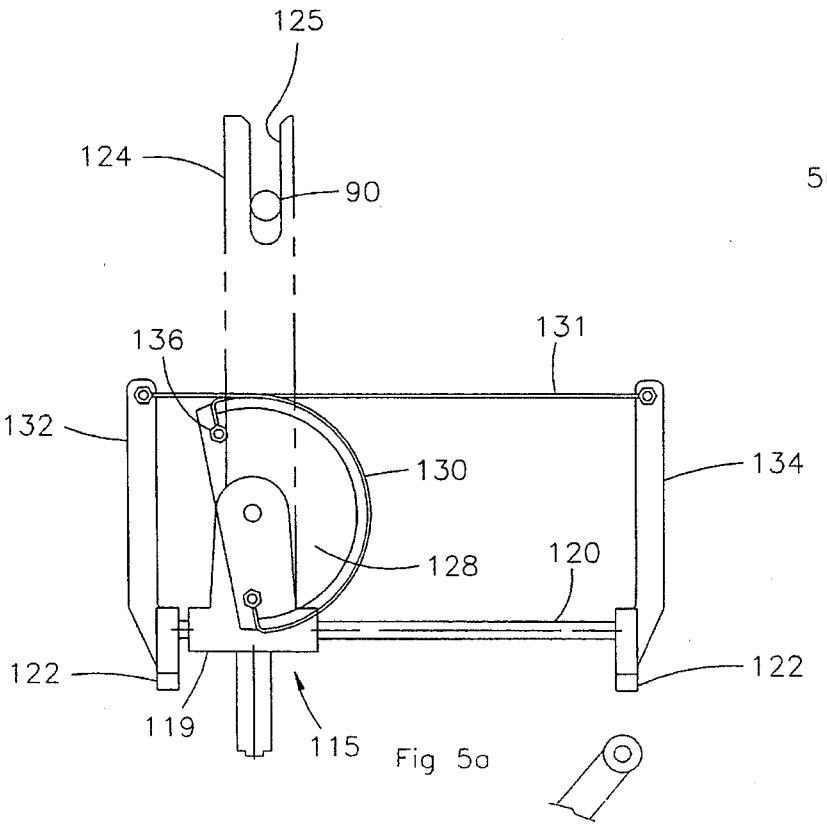
Figure 6:
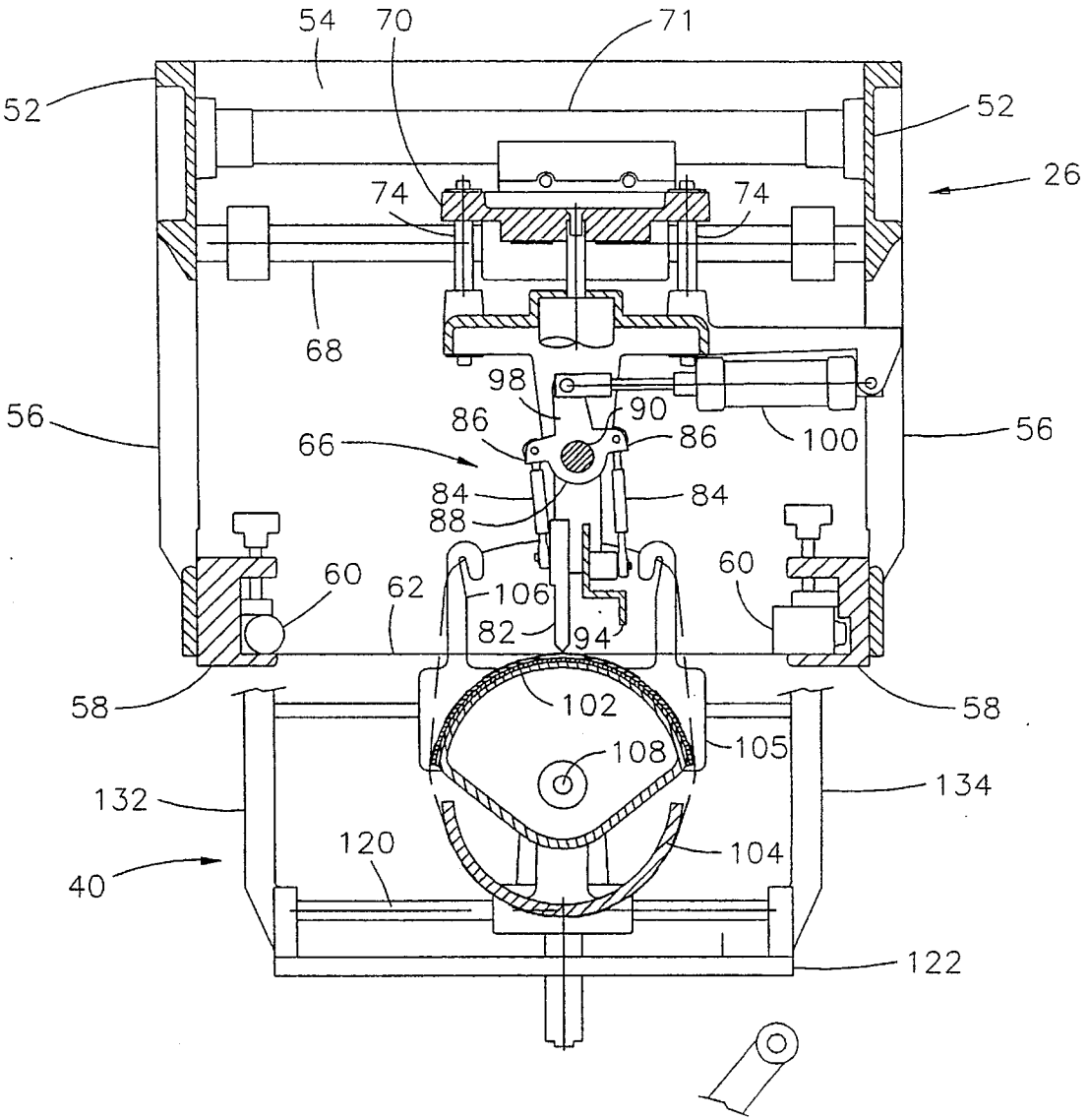
FIG. 6 is a partial view of the same portions shown in FIGS. 4 and 5 illustrating the positions of the squeegee assembly and mandrel at approximately half the way through a printing stroke.
Figure 7:
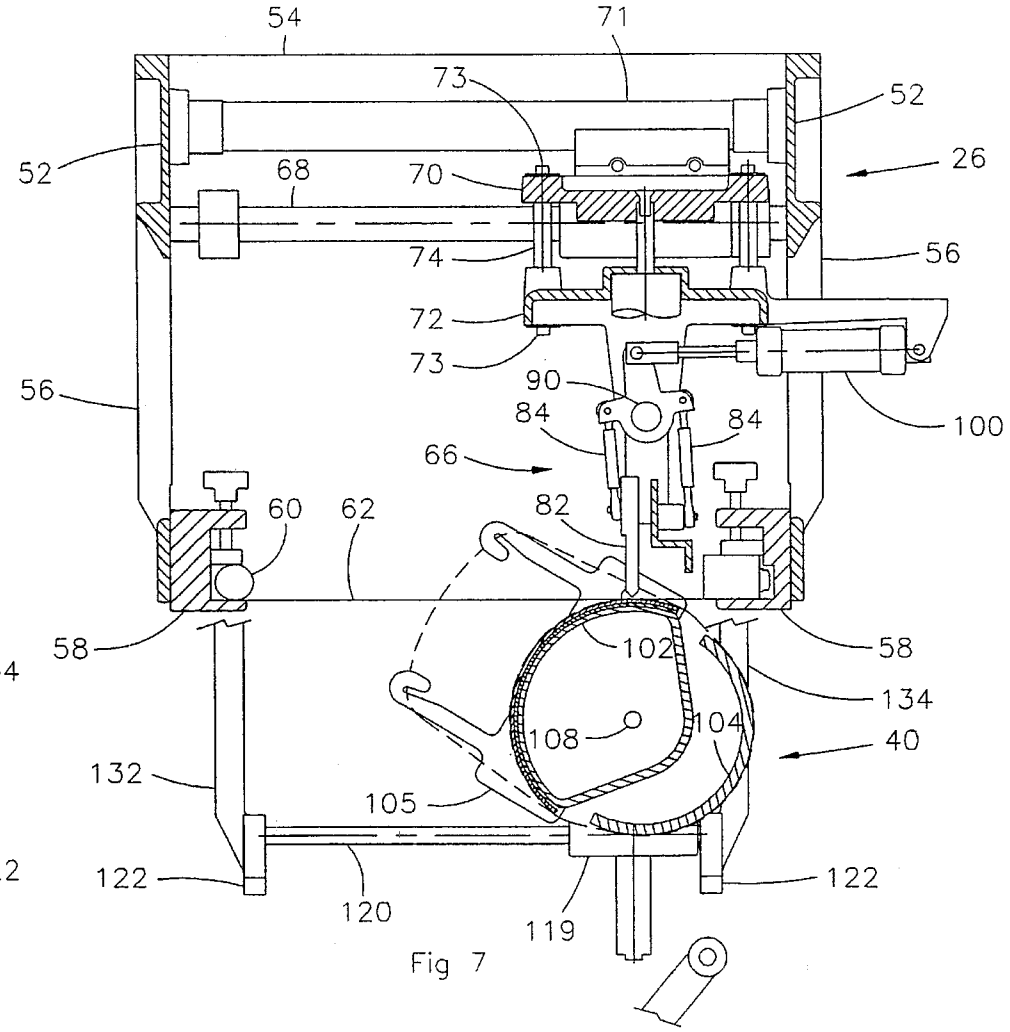
FIGS. 7 and 7*a* are partial views similar to FIGS. 4 and 4*a* illustrating the relative positions of the same portions of the apparatus at the end of a printing stroke.
Figure 7A:
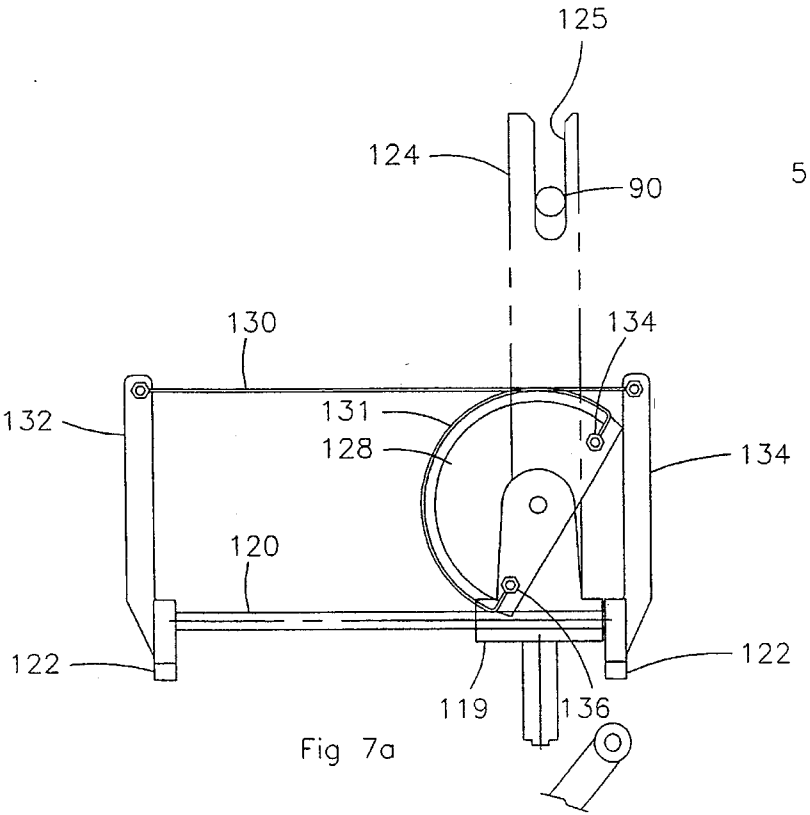
Figure 8:
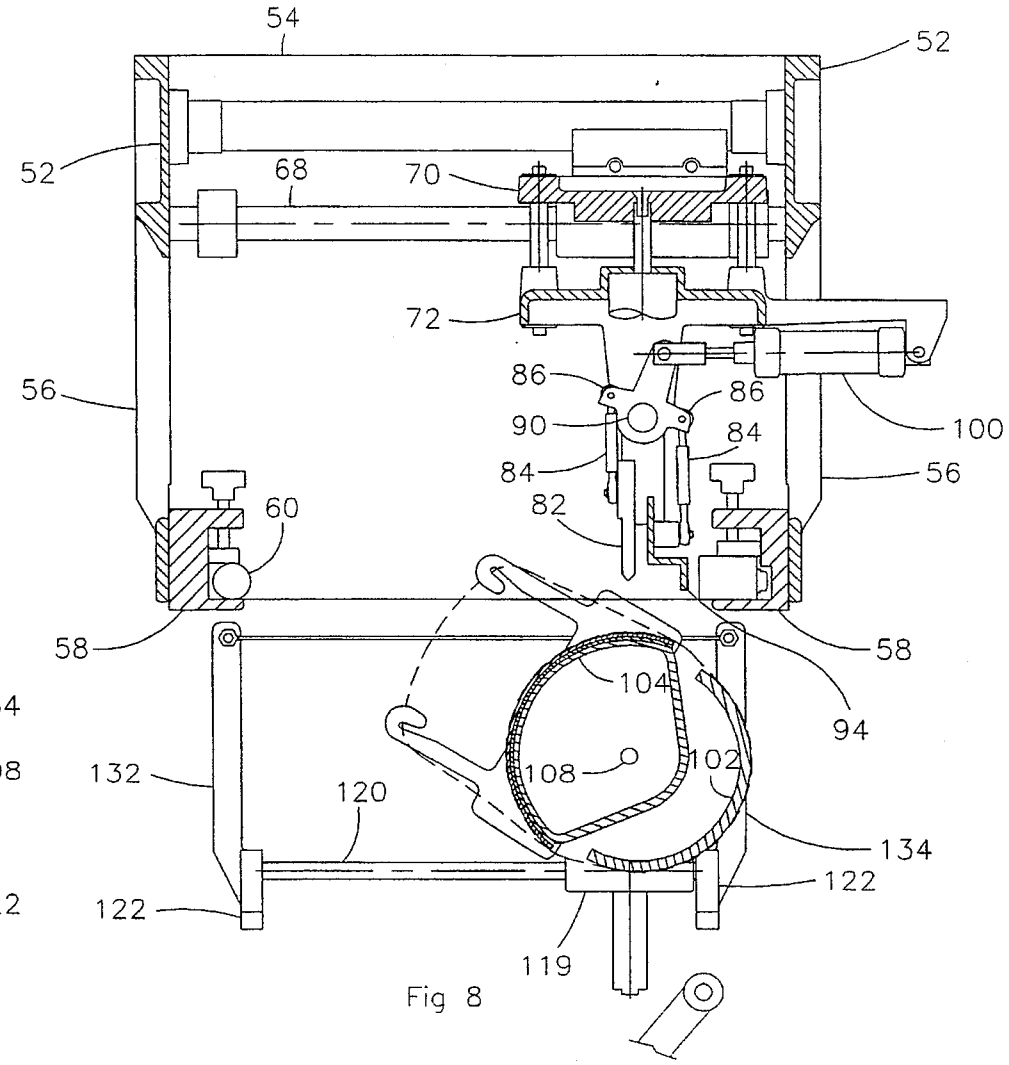
FIGS. 8 and 8*a* are partial views similar to FIGS. 7 and 7*a* illustrating the relative position of the same portions of the apparatus at the beginning of the return stroke when the print head is raised and the flood bar is lowered to redistribute ink over the printing screen.
Figure 8A:
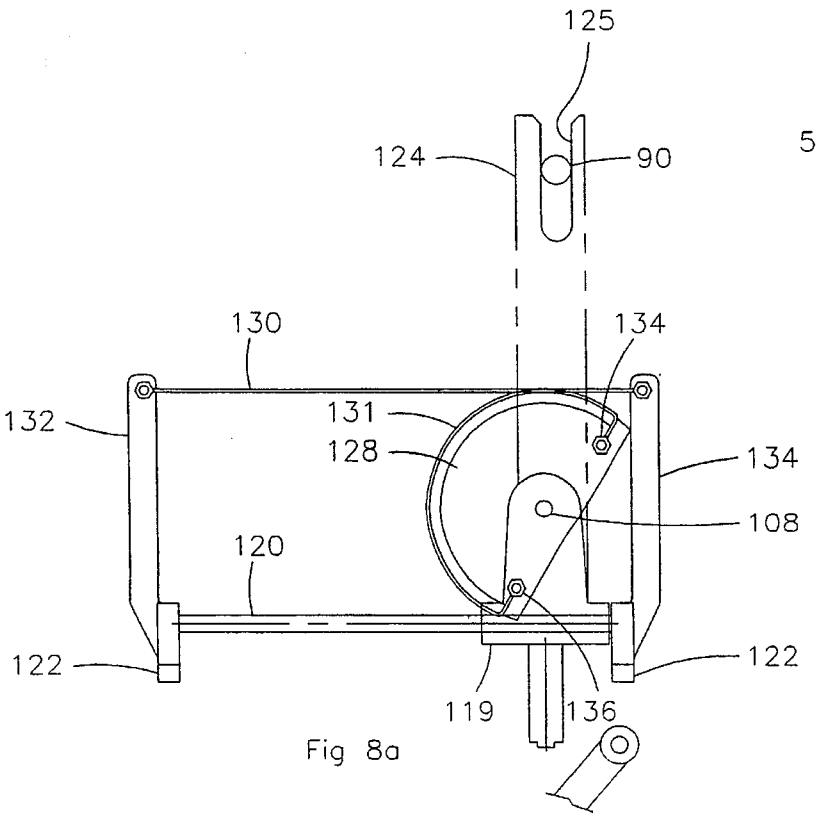
Figure 9:
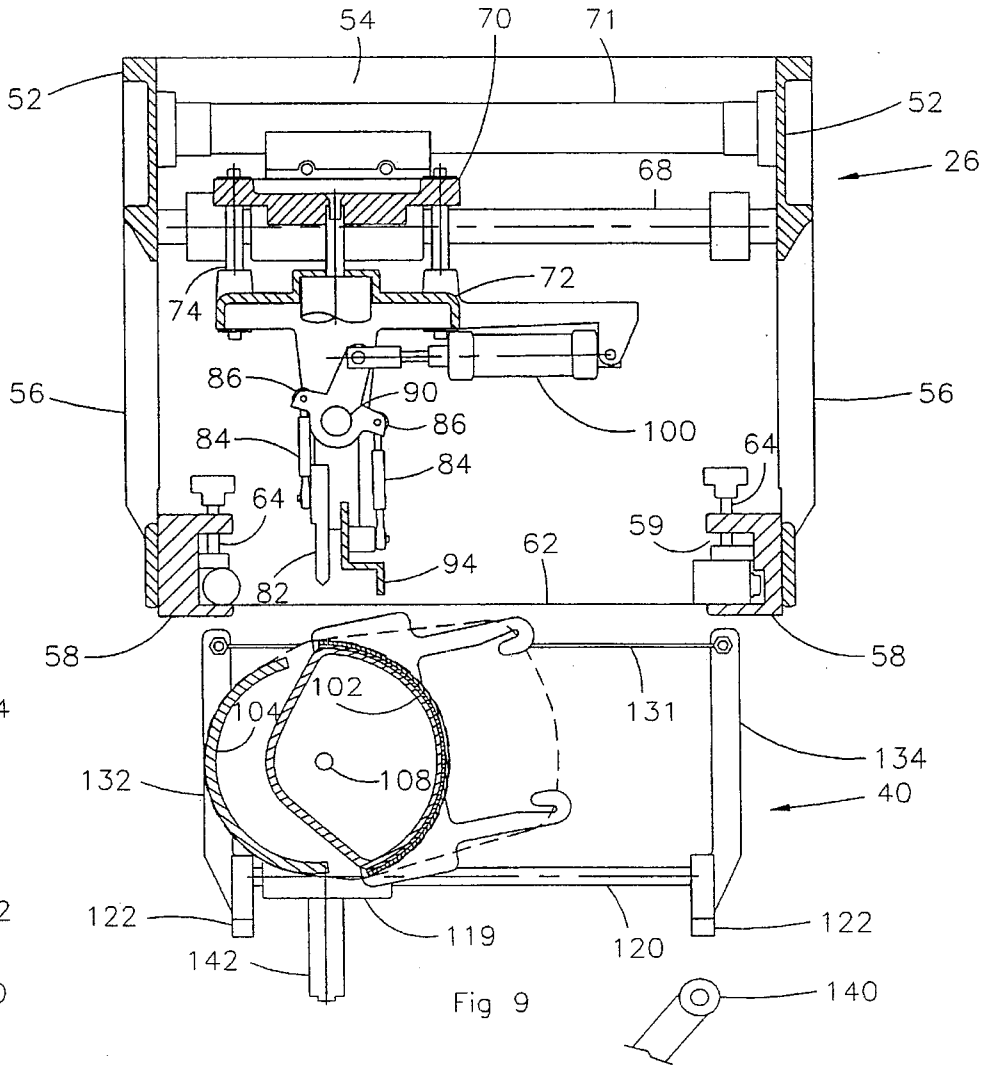
FIGS. 9 and 9*a* are partial views similar to FIGS. 7 and 7*a* illustrating the relative positions of those same portions of the apparatus at the end of the return stroke of the flood bar which ends the printing cycle.
Figure 9A:
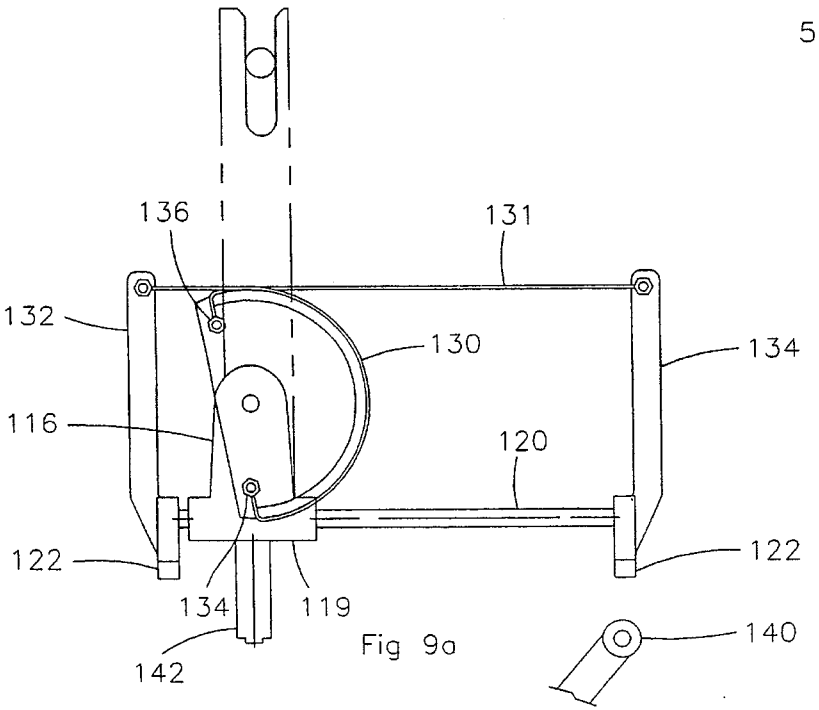

As shown in FIGS. 4, **4*a*, 5 and 5*a*, the mandrel assembly 40 is disposed in its initial indexed starting position with the bill retaining portion 105 rotated to the right as viewed in FIG. 4 and the printing head assembly 26 in a raised non-printing position. Upon actuation of cylinder and piston assembly 34, printing head assembly 26 is lowered and the end 92 of shaft 90 is disposed within vertically extending recess 125 of post 124 thereby forming a releasable latch connection between the horizontal movement of squeegee assembly 66 and mandrel assembly 40 such as shown in FIGS. 5 and 5*a*. Additionally, each notched plate 35 is engaged in a respective one of three of the six bearings 39 fixed to table 24. It should be noted that it is preferred that the engagement between notched plates 35 and bearings 37 positively locate the lowered printing position rather than relying solely upon piston and cylinder assembly 34. It should also be noted that the engagement between plates 35 and bearings 37 require the precise registered location of the printing head assemblies with the mandrel assemblies 40 as determined by the indexing mechanism. The locking engagement between plates 35 and bearings 37 only serve to maintain this precise registered relationship during the printing cycle by fixing support table 24 to the supporting frame including sleeve 30 and arms 32**.

As shown in FIGS. 5 and **5*a*, printing head assembly 26 is lowered to its printing position with screen 62 disposed in very close adjacent relationship with the surface of a cap mounted on mandrel portions 102 and 104. Cylinder 100 is actuated to cause hub 88 to rotate to lower squeegee 82 into engagement with screen 62. Adjustable stops, not shown, may be provided to adjust the vertical position of squeegee 82 to increase or decrease the pressure applied by the squeegee upon screen 62 by limiting the motion of hub 88 about shaft 90**.

At this point, a signal is generated in the control system which actuates band cylinder 71 to drive bracket 70 to the right across guide rails 68. Since shaft 90 is engaged within recess 125 of post 124, trolley frame 115 is also caused to slide along bearing shafts 119 in parallel movement with squeegee assembly 66 as ink in applied to the cap during a printing stroke as shown in the sequence of views seen in FIGS. 6 and 7. At the same time, the movement of trolley frame 115 causes drum 128, as connected to cables 130 and 131, to rotate through a preselected arc which rotates shaft 108 accordingly. Rotation of shaft 108 causes mandrel portions 102 and 104 carrying a cap to rotate through the same arc as drum 128 at a speed matched to the linear speed of travel of squeegee 82 across screen 62 to apply the printed image of screen 62 onto the surface of the cap held on the mandrel.

As squeegee assembly reaches the end of the printing stroke, piston and cylinder assembly 34 is automatically actuated to raise sleeve 30, and accordingly each printing head assembly 26, a relatively short distance. Piston and cylinder assembly 100 is also automatically actuated to rotate hub 88 in the opposite direction to raise squeegee 82 and lower flood bar 94. The printing head assembly is only raised slightly so that flood bar 94 is close to, but not in contact, with screen 62 so that excess ink carried by squeegee 82 toward the right as viewed in the drawings may be redistributed evenly over screen 62 during the return of squeegee assembly 66 to the position seen in FIG. 9. During the return stroke, the degree of vertical raising of printing heads 26 may be sufficient to disengage notched plates 35 and bearings 39. However, during the flooding of screen 62 by flood bar 94, this latched engagement is unnecessary since no printing is taking place. The return travel of squeegee assembly 66 and mandrel assembly 40 is driven by actuation of the return stroke of band cylinder 71. During the return stroke from right to left which completes a printing cycle as viewed in FIGS. 8 and 9, shaft 90 is slightly raised compared to its initial position shown in FIG. 3 but still within recess 125 of post 124. Unless a second printing stroke is desired to apply a heavier coat of ink onto the cap, at the end of a printing cycle, piston and cylinder assembly 34 is actuated to raise printing head assembly 26 to its original non-printing position which causes shaft 90 to be lifted free of recess 125 of post 124. Mandrel assembly 40 has been returned to its initial starting position and support table 24 is now free to rotate the mandrel assemblies to the next station as dictated by actuation of a suitable indexing mechanism connected to table 24.

It should be noted that the relatively complex motion involving both the horizontal and rotational movement of the mandrel portions 102, 104 and 105 during the printing cycle generate forces acting in a tangential direction upon support sleeve 30 through arms 32. Such forces are significant and sufficient to cause unsatisfactory relative movement which can disrupt the registered alignment of printing head assemblies 26 and mandrel assemblies 40 during a printing stroke by deflecting the frame members supporting printing heads 26 or the connection between sleeve support 30 and base frame 20. Any such deflection which allows greater than about five thousandths of an inch in relative motion between the printing head and the mandrel is unsatisfactory for practical commercial acceptance.

However, this problem is adequately solved by providing the arms 33 connected to sleeve 30 and the associated recessed plates 35 at the ends of each arm 33 which engage a respective one of bearings 39 only when sleeve 30 carrying printing head assemblies 26 is lowered to the printing position. Since support table 24 may be releasably fixed in a very secure and stable manner against rotation by conventional indexing apparatus, connection of sleeve 30 with table 24 as described herein provides a secure multiple position, releasable locking engagement to maintain the initial precise alignment location of the printing head assembly 26 relative to the mandrel assembly 40 during the printing stroke of the squeegee assembly.

As an optional feature, it may be deemed desirable to locate the mandrel portions 102 and 104 such that the cap is presented at the unloading and loading stations in a position halfway through the return stroke with the bill of the cap in a vertical position. If this is desired, it may be accomplished at the last printing station by control of the return stroke of band cylinder 71. However, then it is desirable to return the mandrel assembly to its original starting position as it moves to the first printing station adjacent to the loading station 44. In this event, a rotatable arm 140 mounted on base 20 may be provided which is positioned to swing in an arc which will engage a downwardly extending post 142 fixed to trolley frame 115 for moving trolley frame 115 to its desired starting position as shown in FIG. 4.

In view of the foregoing description and the drawings referred to herein it should be readily understood by those of ordinary skill in the art that an automated, multiple station printing apparatus for cap printing capable of high volume, high quality printing is provided by the described construction of the present invention.

We claim:

1. A screen printing apparatus for printing indicia upon the round portion of a cap comprising, in combination;

a) a base frame;

b) a plurality of cap receiving mandrel assemblies fixed in circumferentially spaced relationship to a support frame rotatably mounted to said base frame about a vertical axis defining a rotational path between a plurality of predetermined releasably fixed circumferentially spaced positions, at least two of said positions defining printing stations having a printing head assembly extending radially outward from the axis of rotation of said mandrel assemblies and connected to said base frame in a circumferentially fixed spaced position overlying said printing stations;

c) each of said cap receiving mandrel assemblies having a trolley frame including a cylindrically shaped printing platen mounted to said support frame for movement along a selected generally horizontal path, said cylindrical shaped printing platen being releasably engagable with a head portion of a cap and mounted to said trolley frame for rotation through a selected arc about a generally horizontal axis extending in a radial direction relative the rotational path of travel of said mandrel assemblies about said vertical axis;

d) each of said printing head assemblies being movably mounted to said base frame for vertical travel between a printing and non-printing position and including a print screen holding frame mounted in a fixed position within said printing head assembly and a squeegee assembly mounted for reciprocal travel along a selected generally horizontal path overlying said screen holding frame during a printing cycle;

e) first and second latch portions mounted on said squeegee assemblies and said trolley frames respectively for releasably connecting a squeegee assembly to a trolley frame when said printing head assemblies are disposed in a printing position and said mandrel assemblies are disposed at one of said printing stations to permit said trolley frame and said printing platen to travel with said squeegee assembly at essentially the same linear speed along a generally parallel horizontal path during a printing cycle.

2. The apparatus defined in claim 1 wherein said trolley frame includes a rotatable shaft fixed to said printing platen and extending along a horizontal axis and a drum and cable arrangement operatively connected to said shaft to cause said shaft to rotate said printing platen through a selected arc during travel of said trolley frame along said generally horizontal path during said printing cycle.

3. The apparatus defined in claim 1 wherein each of said printing head assemblies and said rotatably mounted support frame carrying said cap receiving mandrels are releasably locked to one another against rotation about a vertical axis when said printing head assemblies are lowered into said printing position.

4. The apparatus defined in claim 1 wherein each of said printing head assemblies are fixed in radially extending relationship to a collar fixed against rotation above said base frame, said collar being slideably mounted for vertical travel relative to said base frame between said printing and non-printing positions, a plurality of downwardly inclined circumferentially spaced arms provided on said collar, an end of each of said arms being provided with a first lock portion; and a plurality of second lock portions fixed to said rotatably mounted support frame in circumferentially spaced relationship to one another and disposed in a given position related to said printing stations, each of said first lock portions being engagable with a different one of said second lock portions when said printing head assemblies are lowered into said printing position to inhibit relative rotational movement between said collar and said rotatably mounted support frame by tangential forces created during a printing cycle.

5. An automated multiple station cap printing apparatus comprising, in combination;

a) a base frame;

b) a vertically extending central shaft mounted to said base frame;

c) a plurality of printing heads supported in overlying relationship to said base frame in circumferentially spaced relationship to one another and in a fixed radially extending relationship to said central shaft to define printing stations and mounted for vertical movement in an axial direction relative to said central shaft between a raised non-printing position and lowered printing position;

d) a plurality of printing mandrels mounted in predetermined circumferentially fixed spaced relationship to one another to a supporting frame connected to said base frame for movement defining a rotational path about the axis of said central shaft between predetermined releasably fixed positions vertically aligning said printing mandrels with a respective one of said printing heads;

e) each of said printing heads including a mounting conformed to receive a printing screen in a releasably fixed horizontal position and a squeegee assembly mounted for reciprocal linear movement overlying said printing screen in a generally horizontal path disposed generally at a right angle to a radius of the rotational path of said printing mandrels to define a printing cycle;

f) each of said printing mandrels including a trolley frame and a cylindrical platen mounted to said supporting frame for reciprocal linear travel in a selected path generally parallel to the horizontal path of travel of said squeegee assemblies, said cylindrical platen being conformed to releasably receive the head portion of a cap and mounted to a generally horizontal shaft rotatably mounted to said trolley frame and extending in a radial direction relative to said rotational path of said printing mandrels;

g) a rotatable actuator mounted on said trolley frame and connected to said horizontal shaft for reciprocally rotating said cylindrical platen through a selected arc describing a circumferential distance approximately equal to the linear distance of travel of said squeegee assembly over said printing screen;

h) a respective one of said squeegee assemblies being releasably latched to a respective one of said trolley frames to permit each to travel in the same horizontal direction and at essentially the same linear speed during a printing cycle while each of said cylindrical platens are rotated through said selected arc.

* * * * *

UNITED STATES PATENT AND TRADEMARK OFFICE

CERTIFICATE OF CORRECTION

PATENT NO. : 5,490,456

DATED : Feb. 13, 1996

INVENTOR(S) : Orland W. Richardson and Roger J. Gerdeman

It is certified that error appears in the above-indentified patent and that said Letters Patent is hereby corrected as shown below:

TITLE PAGE:

Item No. 73 should read AIM Machining Inc., Columbus, Ohio

Signed and Sealed this

Fourteenth Day of May, 1996

*Attest:*

Bruce Lehman

BRUCE LEHMAN

*Attesting Officer*

*Commissioner of Patents and Trademarks*